US009572736B2

(12) United States Patent
Jenkins et al.

(10) Patent No.: US 9,572,736 B2
(45) Date of Patent: Feb. 21, 2017

(54) ADJUSTABLE BED WITH IMPROVED SHEAR REDUCING MECHANISM

(71) Applicant: Bedlab, LLC, Cumming, GA (US)

(72) Inventors: William Jenkins, Loganville, GA (US); Mark Heflin, Jasper, GA (US)

(73) Assignee: BEDLAB, LLC, Cumming, GA (US)

( * ) Notice: Subject to any disclaimer, the term of this patent is extended or adjusted under 35 U.S.C. 154(b) by 0 days.

(21) Appl. No.: 14/526,323

(22) Filed: Oct. 28, 2014

(65) Prior Publication Data

US 2016/0113828 A1 Apr. 28, 2016

(51) Int. Cl.

| | |
|---|---|
| ***A61G 7/015*** | (2006.01) |
| ***A61G 7/057*** | (2006.01) |
| *A61G 7/002* | (2006.01) |

(52) U.S. Cl.

CPC ..... *A61G 7/015* (2013.01); *A61G 7/0573* (2013.01); *A61G 7/002* (2013.01); *A61G 2203/74* (2013.01)

(58) Field of Classification Search

CPC ..... A61G 7/00; A61G 7/002; A61G 7/015; A61G 7/018; A61G 7/0573; A61G 7/005; A61G 7/16; A61G 13/02; A61G 13/04; A61G 13/08; A61G 2203/74; A61G 7/057

See application file for complete search history.

(56) References Cited

U.S. PATENT DOCUMENTS

| | | | |
|---|---|---|---|
| 984,879 | A | 2/1911 | Bartholome |
| 2,297,105 | A | 9/1942 | Laukhuff |
| 2,400,155 | A | 5/1946 | Letschert et al. |
| 2,587,068 | A | 2/1952 | Sanders |
| 2,651,785 | A | 9/1953 | Berner |
| 3,281,141 | A | 10/1966 | Smiley et al. |
| 3,477,071 | A | 11/1969 | Emerson |
| 3,593,350 | A | 7/1971 | Knight et al. |
| 3,821,821 | A | 7/1974 | Burst et al. |
| 3,875,598 | A | 4/1975 | Foster et al. |
| 3,895,403 | A | 7/1975 | Davis |
| 3,905,055 | A | 9/1975 | Blair |
| 3,913,152 | A | 10/1975 | Quakenbush |
| 3,959,832 | A | 6/1976 | Parsons |
| 4,006,499 | A | 2/1977 | Young |
| 4,183,109 | A | 1/1980 | Howell |
| 4,425,673 | A | 1/1984 | Werner |

(Continued)

FOREIGN PATENT DOCUMENTS

| | | |
|---|---|---|
| WO | WO2008/003027 A2 | 1/2008 |

OTHER PUBLICATIONS

Linear. (n.d.) Collins English Dictionary—Complete and Unabridged, 12th Edition 2014. (1991, 1994, 1998, 2000, 2003, 2006, 2007, 2009, 2011, 2014). Retrieved Jun. 14, 2016 from http://www.thefreedictionary.com/linear.*

(Continued)

*Primary Examiner* — David E Sosnowski
*Assistant Examiner* — Amanda L Miller
(74) *Attorney, Agent, or Firm* — Eric W. Cernyar

(57) ABSTRACT

A sliding thorax assembly subframe is mounted to a thorax assembly main frame section of an articulating bed and is adapted to descend as the torso section of the bed is raised to an inclined position. The mechanism, which is optionally combined with a slideback mechanism to extend the pelvic area of the bed in a longitudinal direction, reduces compressive and shear forces on the patient during bed articulation.

19 Claims, 15 Drawing Sheets

(56) References Cited

U.S. PATENT DOCUMENTS

| | | | |
|---|---|---|---|
| 4,446,587 | A | 5/1984 | Jump |
| 4,536,903 | A | 8/1985 | Parker |
| 4,654,903 | A | 4/1987 | Chubb et al. |
| 4,685,159 | A | 8/1987 | Oetiker |
| 4,868,937 | A | 9/1989 | Connoly |
| 4,947,496 | A | 8/1990 | Connoly |
| 4,996,731 | A | 3/1991 | Kruyt |
| 5,023,967 | A | 6/1991 | Ferrand |
| 5,142,719 | A | 9/1992 | Vrzalik |
| 5,161,274 | A | 11/1992 | Hayes et al. |
| 5,438,723 | A | 8/1995 | Carroll |
| 5,500,964 | A | 3/1996 | Bergersen |
| 5,568,661 | A | 10/1996 | Bathrick et al. |
| 5,577,280 | A | 11/1996 | Elliott |
| 5,608,932 | A | 3/1997 | Hasegawa |
| 5,611,096 | A | 3/1997 | Bartlett |
| 5,640,730 | A | 6/1997 | Godette |
| 5,715,548 | A | 2/1998 | Weismiller et al. |
| 5,781,949 | A | 7/1998 | Weismiller |
| 5,790,997 | A | 8/1998 | Ruehl |
| 5,802,640 | A | 9/1998 | Ferrand et al. |
| 5,862,551 | A | 1/1999 | Oguma et al. |
| 6,006,379 | A | 12/1999 | Hensley |
| 6,088,853 | A | 7/2000 | Jansen |
| 6,101,647 | A | 8/2000 | Stroud et al. |
| 6,154,900 | A | 12/2000 | Shaw |
| 6,212,713 | B1 | 4/2001 | Kuck et al. |
| 6,216,295 | B1 | 4/2001 | Pearson |
| 6,289,536 | B1 | 9/2001 | Betson |
| 6,378,148 | B1 | 4/2002 | Votel |
| 6,499,162 | B1 | 12/2002 | Lu |
| 6,640,365 | B1 | 11/2003 | Chang |
| 6,658,680 | B2 | 12/2003 | Osborne et al. |
| 6,892,405 | B1 | 5/2005 | Dimitrio |
| 7,032,261 | B2 | 4/2006 | Heimbrock |
| 7,036,166 | B2 | 5/2006 | Kramer et al. |
| 7,441,291 | B2 | 10/2008 | Hayes et al. |
| 7,559,102 | B1 * | 7/2009 | Benzo ..... A61G 7/015 5/617 |
| 7,761,942 | B2 | 7/2010 | Benzo et al. |
| 7,849,539 | B2 | 12/2010 | Hornbach et al. |
| 8,601,618 | B2 | 12/2013 | Benzo et al. |
| 2004/0148704 | A1 | 8/2004 | Tekulve |
| 2004/0250349 | A1 | 12/2004 | Rene |
| 2009/0094746 | A1 * | 4/2009 | Ferraresi ..... A61G 7/0573 5/609 |

OTHER PUBLICATIONS

Line. (n.d.) Collins English Dictionary—Complete and Unabridged, 12th Edition 2014. (1991, 1994, 1998, 2000, 2003, 2006, 2007, 2009, 2011, 2014). Retrieved Jun. 14, 2016 from http://www.thefreedictionary.com/line.*

* cited by examiner

ADJUSTABLE BED WITH IMPROVED SHEAR REDUCING MECHANISM

FIELD OF THE INVENTION

This invention relates generally to specialized beds and surfaces, and more particularly, to adjustable and articulating beds for use in hospitals and other care settings and in homes for at-risk patients.

BACKGROUND OF THE INVENTION

Normally in adjustable specialty beds, when the torso is elevated more than 30 degrees, the lower portion of the torso surface compresses the lumbo-sacral area and induces the patient to slide toward the foot-end area of the bed. This not only causes discomfort, but also increases the risks of shear-lesion and pressure ulceration.

Accordingly, there is a need for a mechanism that minimizes compression of the lumbo-sacral area during articulation of the torso surface toward an inclined position.

U.S. Pat. No. 7,559,102, entitled "Adjustable Bed With Sliding Subframe for Torso Section," discloses an articulating bed with a slideback mechanism that causes displacement of the bed's torso section away from bed's pelvic section as the torso section articulates up. While this reduces the compression and shear forces described above, it would be advantageous to reduce those forces even further.

SUMMARY OF THE INVENTION

In one characterization of the invention, an articulating bed comprises a support surface, a pelvic assembly, and a thorax assembly coupled for articulation to the pelvic assembly about an articulation axis between flat and inclined positions. The thorax assembly includes a subframe slidably mounted to a main frame. The subframe is positioned under a portion of the support surface configured to support a lower thoracic region of a person lying on the support surface. The main frame is positioned under a portion of the support surface configured to support an upper thoracic region of a person lying on the support surface. The subframe and the main frame each bear corresponding portions of the support surface. A displacement mechanism translates the thorax assembly subframe between first and second limits relative to the thorax main frame. The bed is operable, via computer programming or direct mechanical inter-coupling, for examples, to displace the thorax assembly subframe toward the first limit as the thorax assembly is articulated toward the inclined position. Likewise, the bed is operable wherein the bed is operable to displace the thorax assembly subframe toward the second limit as the thorax assembly is articulated toward the flat position.

In another aspect of this characterization of the invention, the thorax assembly subframe is coupled to the thorax main frame for travel along an axis that is substantially perpendicular to a thorax-bearing region of the support surface. In yet another aspect, at the first limit, the thorax assembly subframe is positioned downwardly of the thorax main frame, and at the second limit, the thorax assembly subframe is aligned with the thorax main frame.

At a minimum, the displacement mechanism comprises either an actuator to drive displacement between the thorax assembly subframe and the thorax assembly main frame or a mechanical coupling that causes movement of another portion of the bed to drive the displacement. The displacement mechanism optionally comprises also guides that slidingly couple the thorax assembly subframe for linear travel with respect to the thorax assembly main frame between the first and second limits.

The displacement mechanism is arranged to avoid interference with mechanisms used to articulate the bed. For example, a thorax assembly articulation actuator may be coupled to a thorax assembly articulation lever and operable to drive the thorax assembly between flat and inclined positions. The thorax assembly articulation lever may be fixedly mounted to the thorax assembly main frame, with the lever extending through an opening in the thorax assembly subframe. In such a configuration, the thorax assembly articulation lever may be arranged to be operable to drive the thorax assembly main frame without interference with the thorax assembly subframe, and the thorax assembly subframe likewise operable to travel between its limits without interference with the thorax assembly articulation lever.

The articulating bed may also provide a second displacement mechanism that displaces a pelvic assembly subframe outwardly from a pelvic assembly main frame. A scissoring mechanism may be mounted to the thorax assembly subframe and operable to raise and contract a corresponding portion of the support surface to embrace an abdominal area of a person lying on the surface. A head-end scissoring mechanism may be mounted to the thorax assembly main frame and operable to raise and contract a corresponding portion of the patient support to cradle a patient's upper body and head.

In another characterization of the invention, an articulating bed comprises a pelvic assembly subframe slidingly coupled to a pelvic assembly main frame and a thorax assembly subframe slidingly coupled to a thorax assembly main frame. A pelvic assembly actuator is operable to extend and retract the pelvic assembly subframe with respect to the pelvic assembly main frame as the bed articulates between flat and inclined positions. A thorax assembly actuator operable to extend and retract the thorax assembly subframe with respect to the thorax assembly main frame as the bed articulates between flat and inclined positions.

In one embodiment, the thorax assembly actuator is operable to extend the thorax assembly subframe downwardly as the bed articulates from a flat position to an inclined position. In another embodiment, the pelvic assembly actuator is operable to extend the pelvic assembly subframe outwardly as the bed articulates from a flat position to an inclined position.

In yet another characterization of the invention, an articulating bed comprises a pelvic assembly and a thorax assembly coupled for articulation to the pelvic assembly. The pelvic assembly includes a pelvic assembly subframe coupled to a pelvic assembly main frame that is operable to translate outwardly toward a head-end of the bed when the thorax assembly articulates toward an inclined position. The thorax assembly includes a thorax main frame pivotally coupled to the translating pelvic assembly subframe and a sliding thorax assembly subframe coupled to the thorax assembly main frame and adapted to translate in a direction that is substantially perpendicular to the thorax assembly subframe.

A support surface may be mounted to the pelvic and thorax assemblies for movement with the pelvic and thorax assembly subframes to reduce shear and compression forces on a patient as the bed articulates between flat and inclined positions.

These are just some of the possible characterizations of the invention. It is the inventors' intent that the scope of any of the claims be defined by the language of the claims, and not narrowed by reference to the preferred embodiments described in this summary or in the detailed description of the invention.

DETAILED DESCRIPTION

Figure 1:
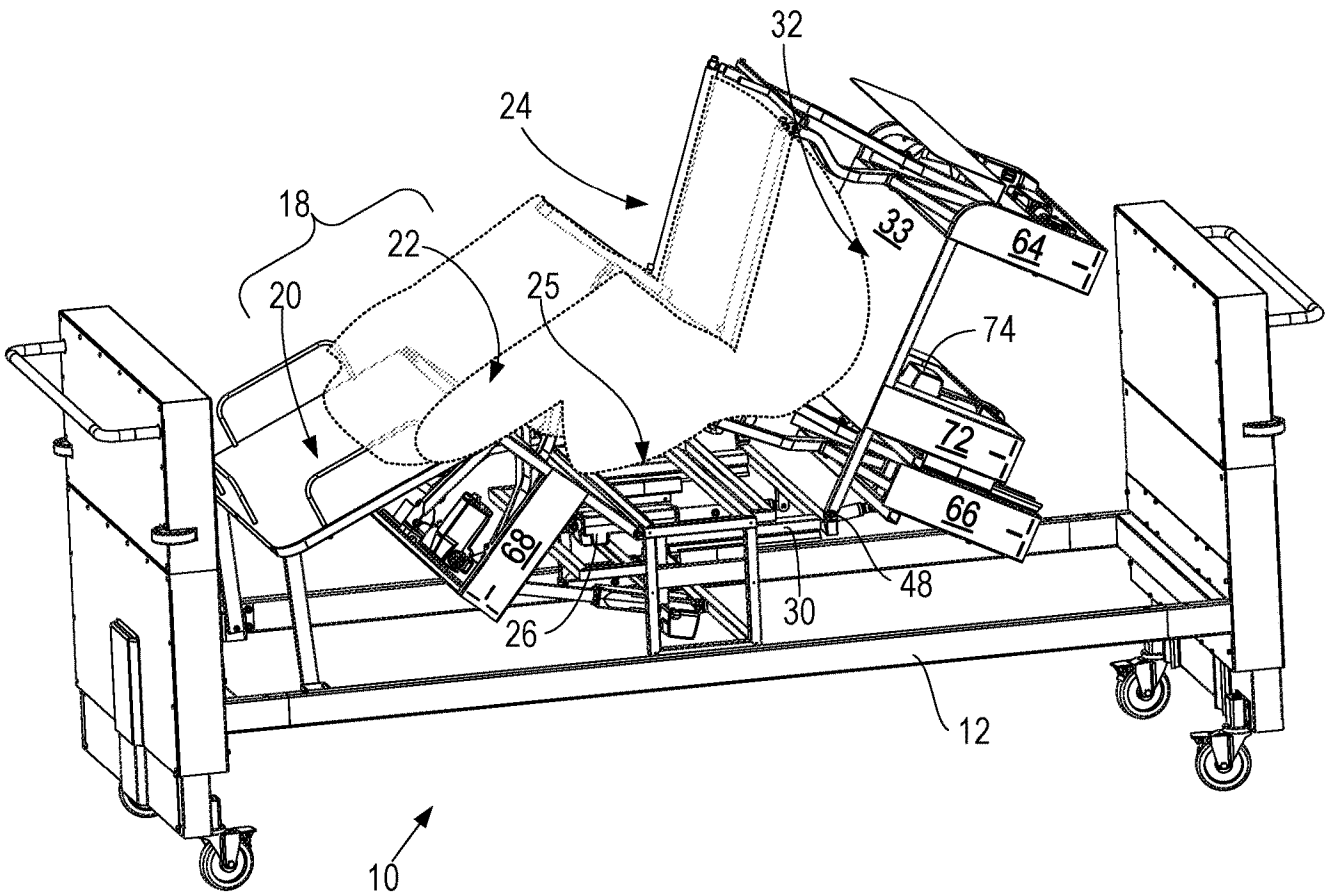
FIG. 1 is a perspective view of one embodiment of an articulating bed with an improved shear reduction mechanism.
Figure 2:
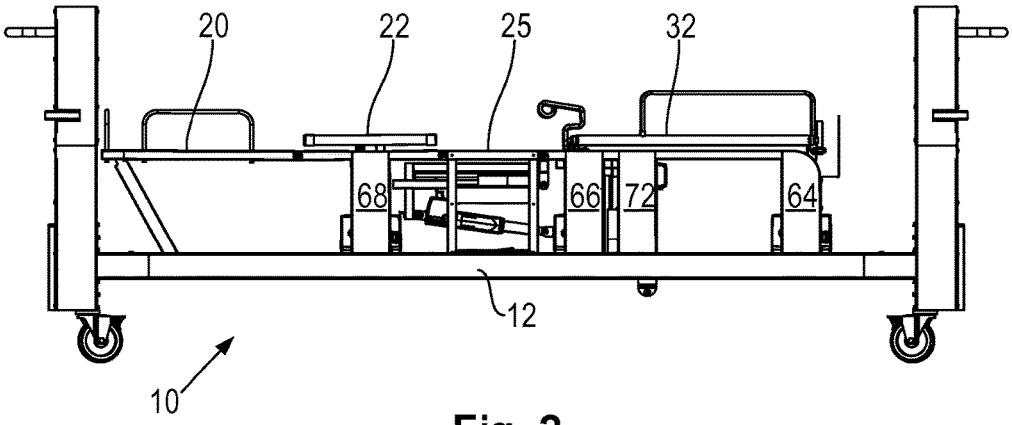
FIG. 2 is a side plan view of the articulating bed of FIG. 1 with the articulating bed flat and a first displacement mechanism in a fully retracted position.

In describing preferred and alternate embodiments of the technology described herein, as illustrated in FIGS. 1-17, various terms are employed for the sake of clarity. The technology described herein, however, is not intended to be limited to the specific terminology so selected, and it is to be understood that each specific element includes all technical equivalents that operate in a similar manner to accomplish similar functions. Moreover, the words employed to describe the technology do not necessarily perfectly conform to dictionary definitions, as will be evident from the context in which the words are used.

FIGS. 1-17 illustrate perspective views of different embodiments of an adjustable, articulatable bed 10 that extends along a longitudinal dimension between a head end and a foot end.

The articulating bed 10 comprises a base frame 12, an articulating midframe 15 (FIG. 5), a dual-axis displacement mechanism 40, (optionally) a modulating superframe 60 (FIG. 4), a patient support surface 24, and circuitry, controllers and associated software (not shown) for operating various bed functions. The base frame 12 provides Trendelenburg and reverse Trendelenburg functions (not shown), includes casters enabling the bed to be easily rolled down a hallway or maneuvered into place, and optionally incorporates a siderail framework (not shown) to prevent a patient from rolling off the bed.

Figure 13:
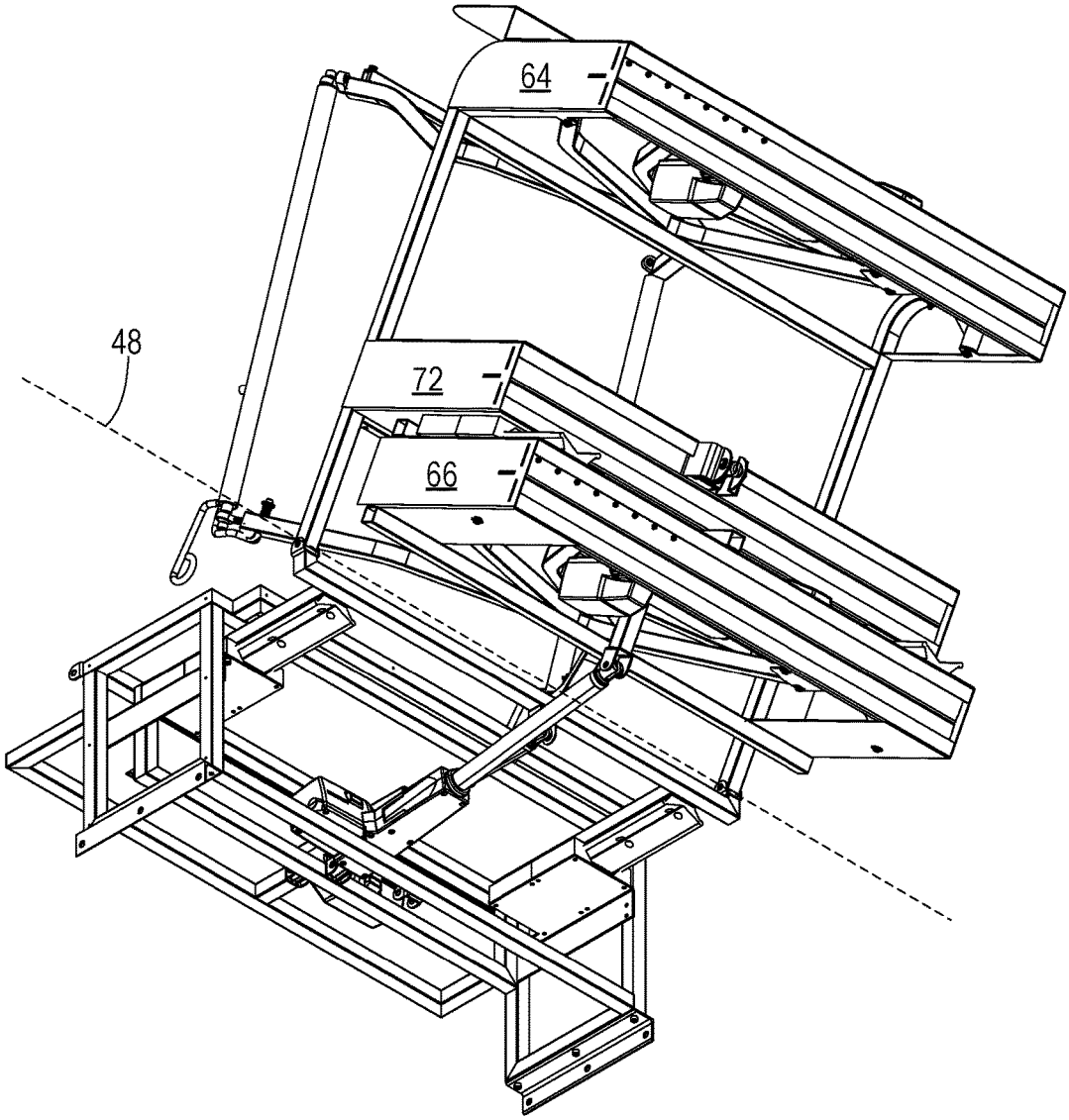
FIG. 13 is like FIG. 10 except that it is also a perspective view, from a bottom angle.
Figure 14:
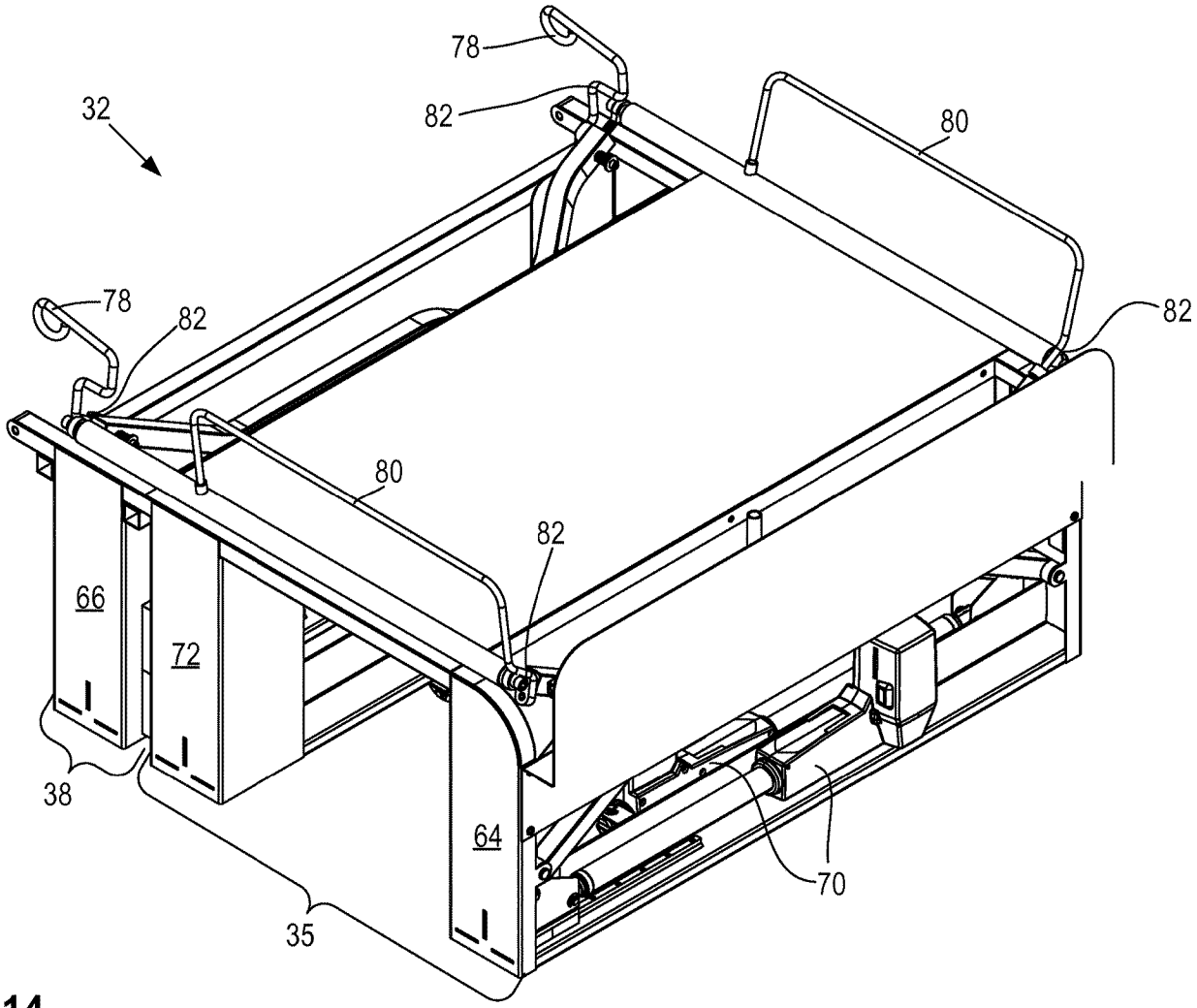
FIG. 14 is a top-angled perspective view of the thorax assembly.
Figure 15:
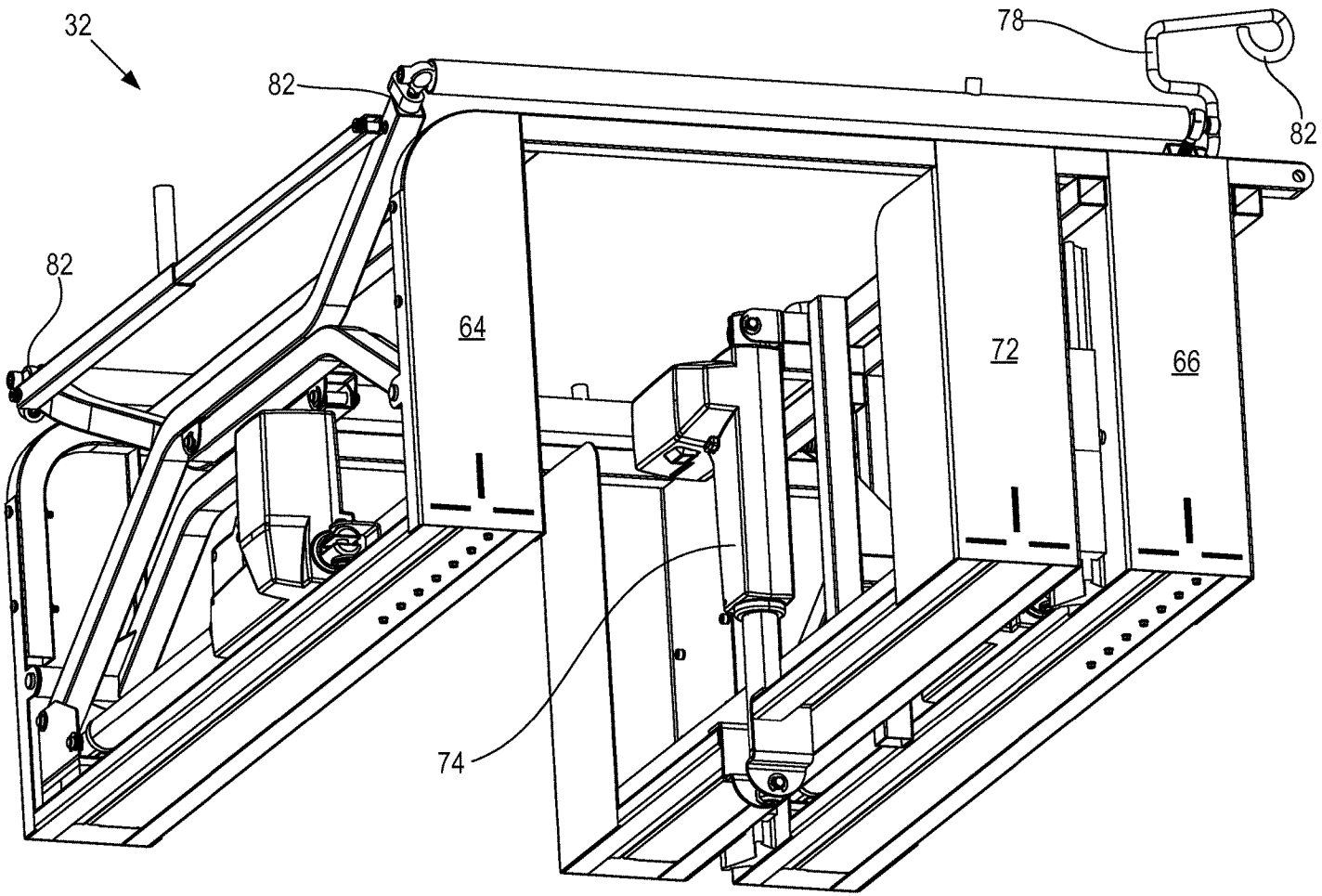
FIG. 15 is a bottom-angled perspective view of the thorax assembly.
Figure 16:
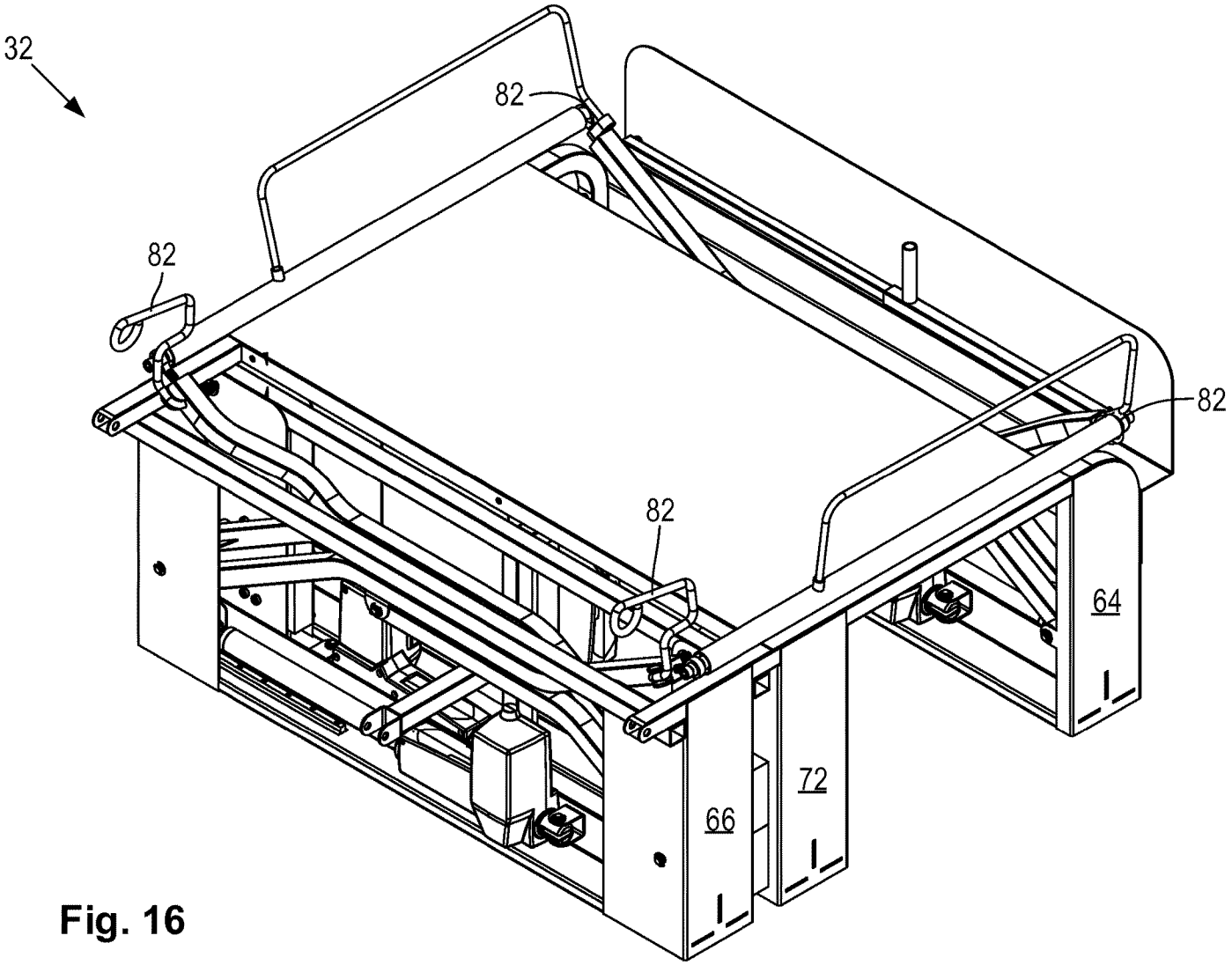
FIG. 16 is another top-angled perspective view of the thorax assembly.
Figure 17:
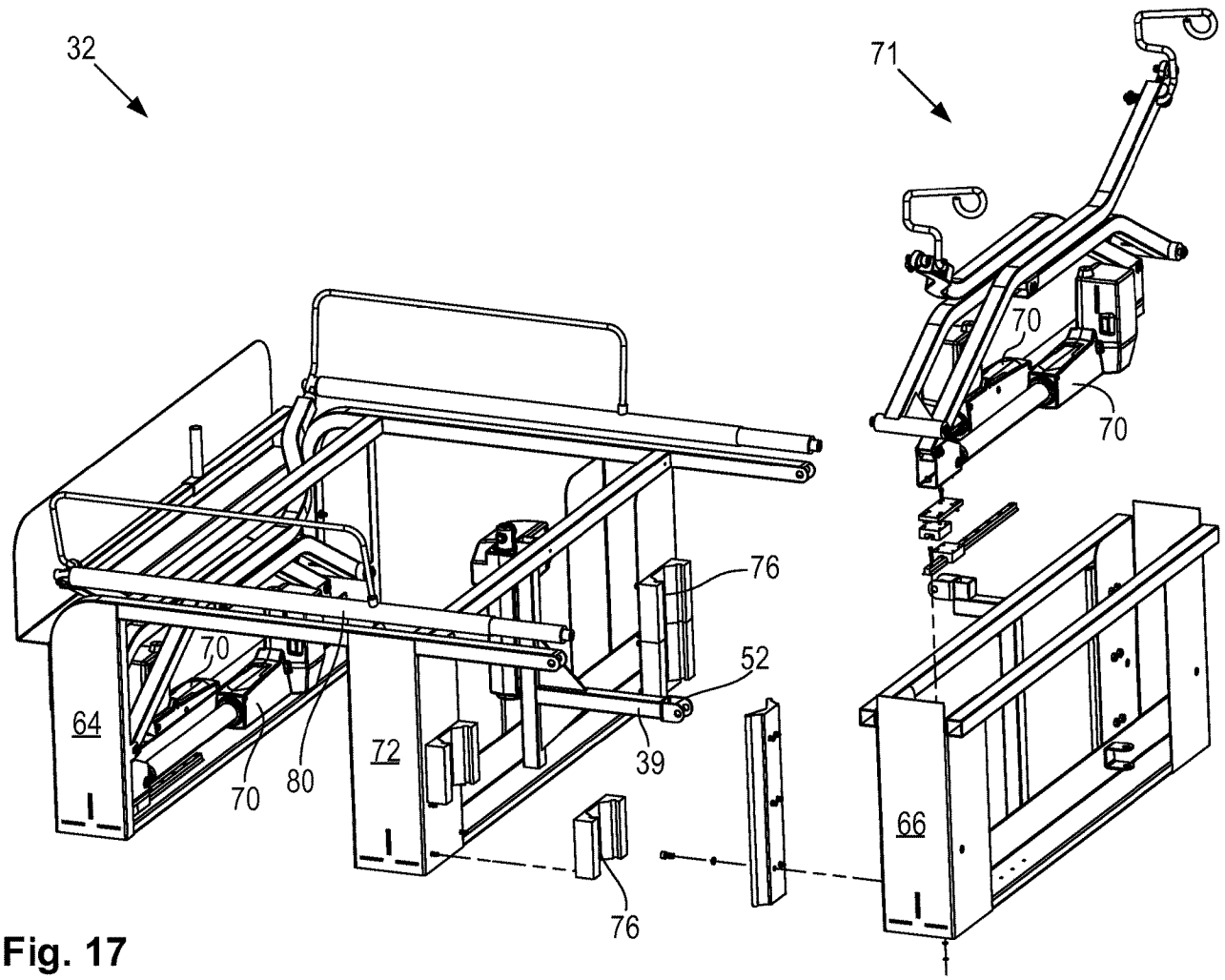
FIG. 17 is an exploded view diagram of the thorax assembly.

The articulating midframe 15 resembles in some aspects a conventional articulating hospital bed deck, less some of the deck surfaces. The articulating midframe 15 comprises a leg assembly 18 oriented under an area where a patient's legs would lie, a pelvic assembly 25 oriented under an area where a patient's pelvis would rest, and a thorax assembly or torso section 32 oriented under an area where a patient's upper body would repose. The leg assembly 18 includes a lower leg assembly 20 and an upper leg assembly 22 (FIG. 1) coupled for articulation with respect to each other. The upper leg assembly 22 is pivotally coupled to the pelvic assembly 25. In the depicted embodiments, the pelvic assembly 25 is stationary with respect to the base frame 12, to which it is fixedly mounted, but in other embodiments may be made to articulate as well. The thorax assembly 32 is coupled for articulation to the pelvic assembly 25 about a pivot axis 48 (FIG. 13). The pivot axis 48 is also referred to herein as the torso tilt axis.

Figure 10:
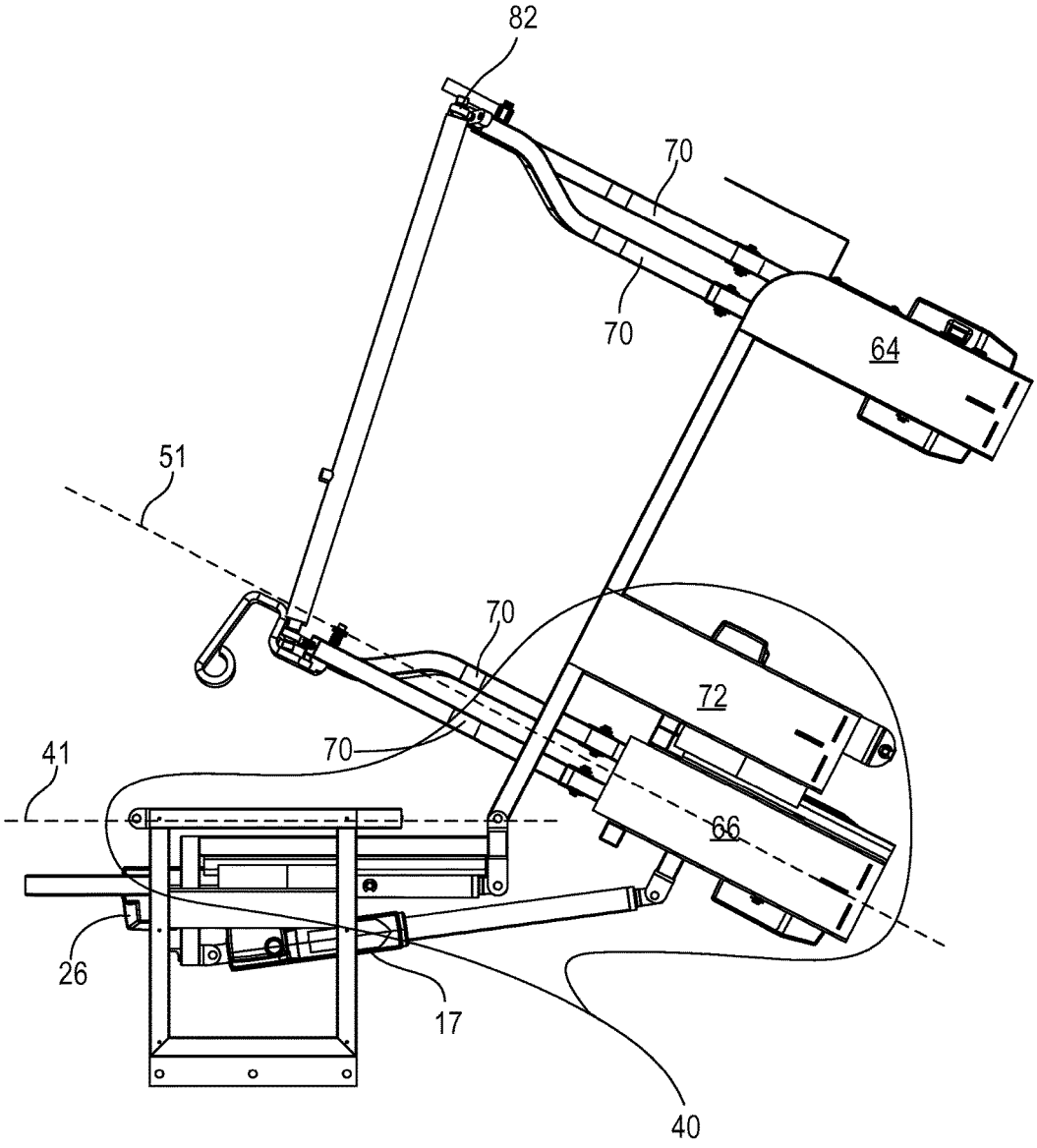
FIG. 10 is like FIG. 9 but with the thorax assembly articulated in an inclined position relative to the pelvic assembly.
Figure 11:
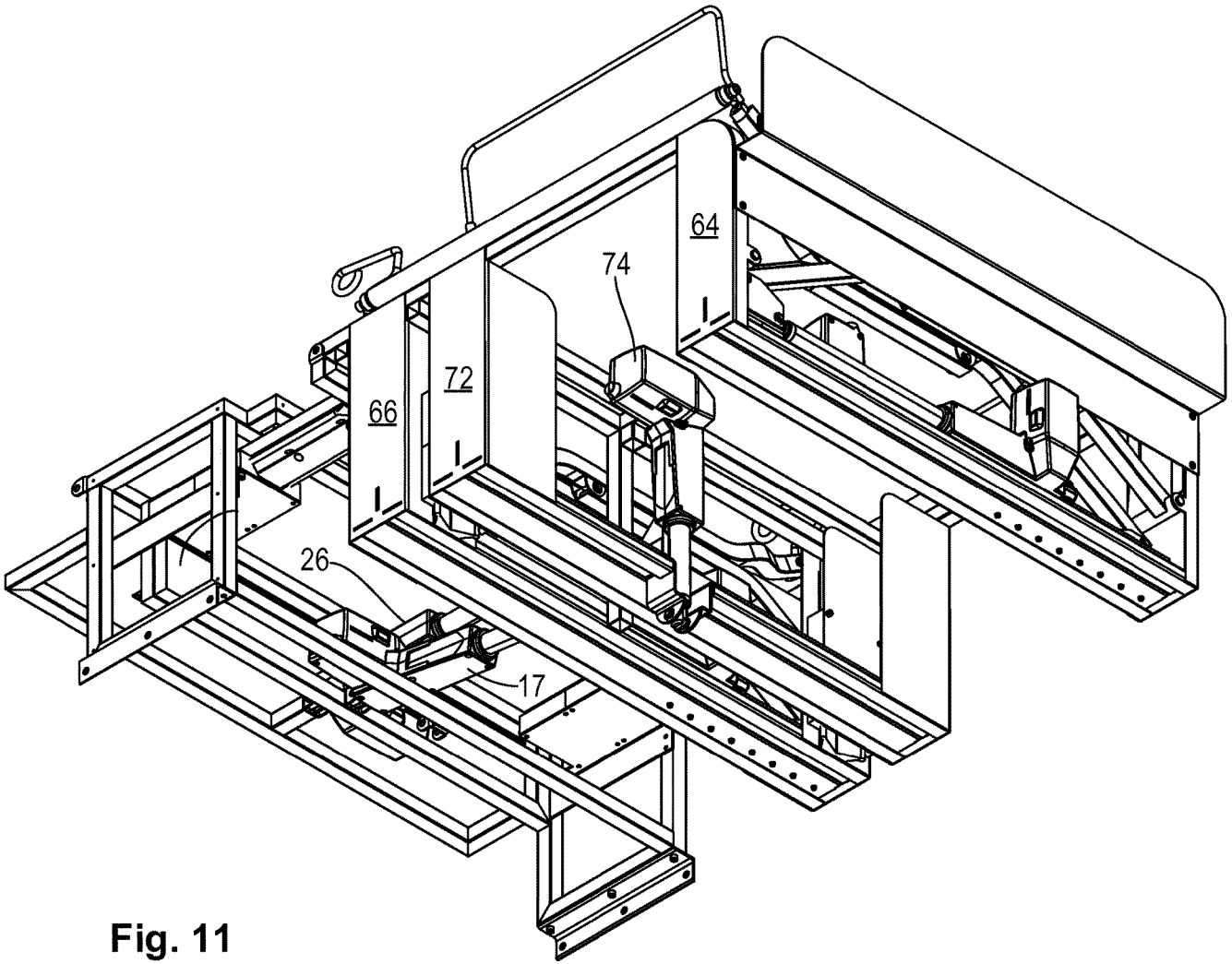
FIG. 11 is like FIG. 8 except that it is a perspective view, from a bottom angle, of the thorax and pelvic assemblies.
Figure 12:
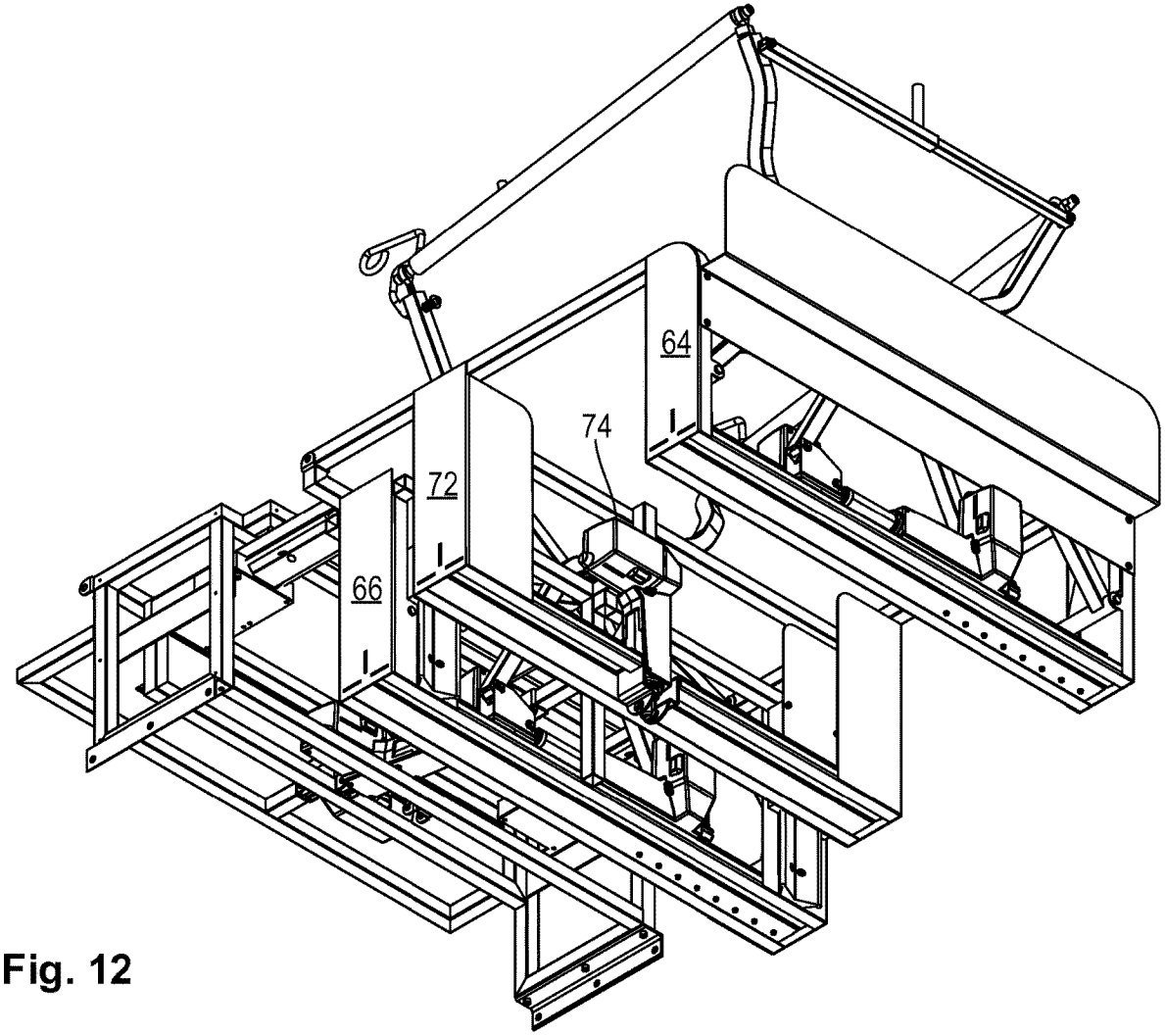
FIG. 12 is like FIG. 9 except that it is also a perspective view, from a bottom angle.

The improvements most relevant to the claims of this particular application are those that reduce compression of the lump-sacral area during articulation of the thorax assembly 32 between high-tilt and low-tilt or zero-tilt orientations. These improvements include, according to one non-exclusive characterization of the invention, a dual-axis displacement mechanism 40 (FIG. 10). The dual-axis displacement mechanism 40 comprises a first displacement mechanism 42 (FIG. 3) that extends (or contracts) the pelvic area of the bed along the bed's longitudinal axis 41 (FIG. 10) and a second displacement mechanism 50 (FIG. 4) that creates or enlarges (or contracts) a depression in the lower thoracic area of the bed along an axis 51 (FIG. 10) perpendicular to the thorax assembly 32.

More particularly, the first displacement mechanism 42 translates a pelvic assembly subframe 30 (FIG. 8) that is slidingly mounted via a guide to an underside of a pelvic assembly main frame 28 outwardly in a parallel, linear, and substantially horizontal direction from the pelvic assembly main frame 28. The second displacement mechanism 50 translates a thorax assembly subframe 38 that is slidingly mounted to a forward part of a thorax assembly main frame 35 in an orthogonal, substantially downward direction 51 from the thorax assembly main frame 35.

The first displacement mechanism 42, also referred to herein as a "slideback" mechanism, displaces the torso tilt axis 48 using structure similar to that described in U.S. Pat. No. 7,559,102, which is herein incorporated by reference. An actuator 26 (FIGS. 1, 7, 11) mounted on the pelvic assembly 25 drives a rod 27 (FIG. 9) that causes a sliding pelvic assembly subframe 30 to extend outwardly or retract inwardly in a linear horizontal direction, from or into the pelvic assembly main frame 28. The sliding pelvic assembly subframe 30 carries the torso tilt axis 48. These actions, in turn, cause the region bridging the pelvic assembly main frame 28 and thorax assembly main frame 35 to lengthen or contract. Lengthening this region as the thorax assembly main frame 35 articulates into an inclined position reduces compression forces on the patient. Likewise, contracting this region as the thorax assembly main frame 35 moves down into a flat position reduces shear forces on the patient.

Figure 3:
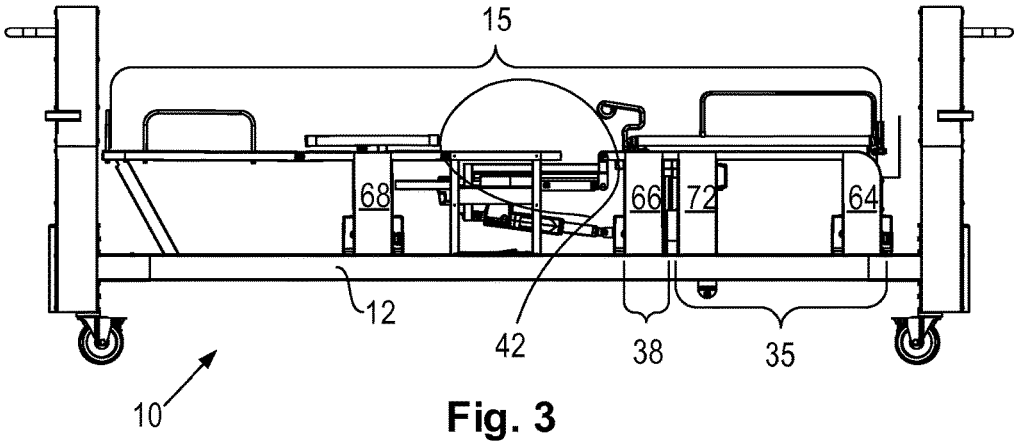
FIG. 3 is a side plan view of the articulating bed of FIG. 1 with the first displacement mechanism in a fully extended position.

U.S. Pat. No. 7,559,102 did not describe the second displacement mechanism 50 of the present invention. The second displacement mechanism 50 comprises a thorax assembly subframe 38 slidingly connected to a thorax assembly main frame 35 (FIG. 3). The thorax assembly subframe 38 is coupled for linear travel, along a direction 51 perpendicular to the upper side of the thorax assembly 32, between first and second limits, wherein the first limit aligns the subframe 38 with the main frame 35, and the second limit causes the subframe 38 to assume a recessed position with respect to the main frame 35.

The thorax assembly main frame 35 and subframe 38 each provide structure for bearing corresponding portions of the patient support surface 24. The thorax assembly subframe 38 provides structure for bearing the patient support surface 24 in the vicinity of a patients lower thorax. The thorax assembly main frame 35 provides structure, including a deck or platform section 33, for bearing the patient support surface 24 in the vicinity of the patients mid and upper thorax. As the thorax assembly 32 articulates upwardly into a tilted position, the second displacement mechanism 50 moves the thorax assembly subframe 38 downwardly, creating a depression in the lower thoracic area of the bed surface along an axis perpendicular to the thorax assembly 32. Likewise, as the thorax assembly 32 articulates downwardly to a flat position, the second displacement mechanism 50 moves the thorax assembly subframe 38 back up into alignment with the main frame 35, eliminating or reducing the depression formerly created by the subframe 38's downward extension. These actions, which are preferably (but optionally) combined with the slideback motion, reduce compressive and shear forces on the patient as the thorax assembly 32 is moved between inclined and flat positions.

Figure 4:
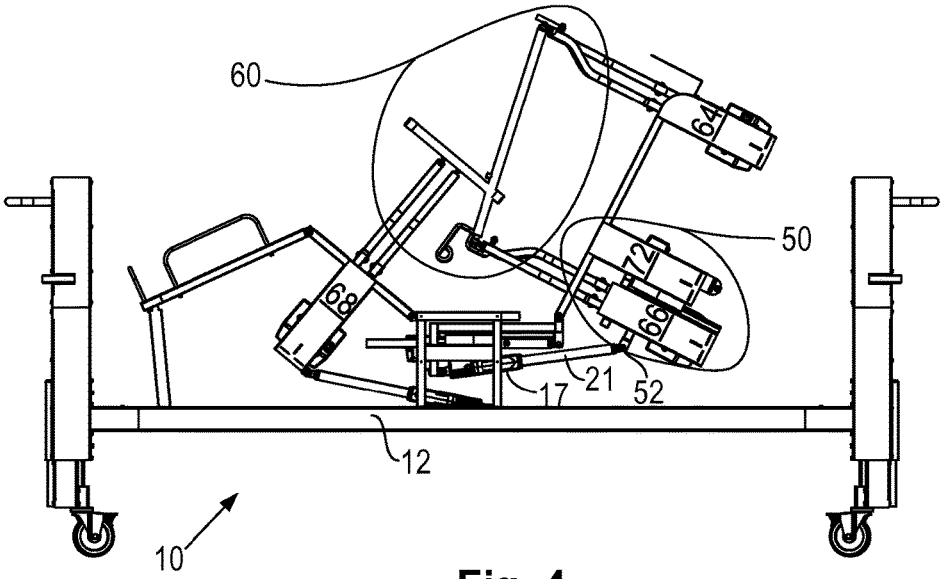
FIG. 4 is a side plan view of the articulating bed of FIG. 1 with the bed fully articulating and the first displacement mechanism in an extended position and a second displacement mechanism in a deeply recessed position.
Figure 5:
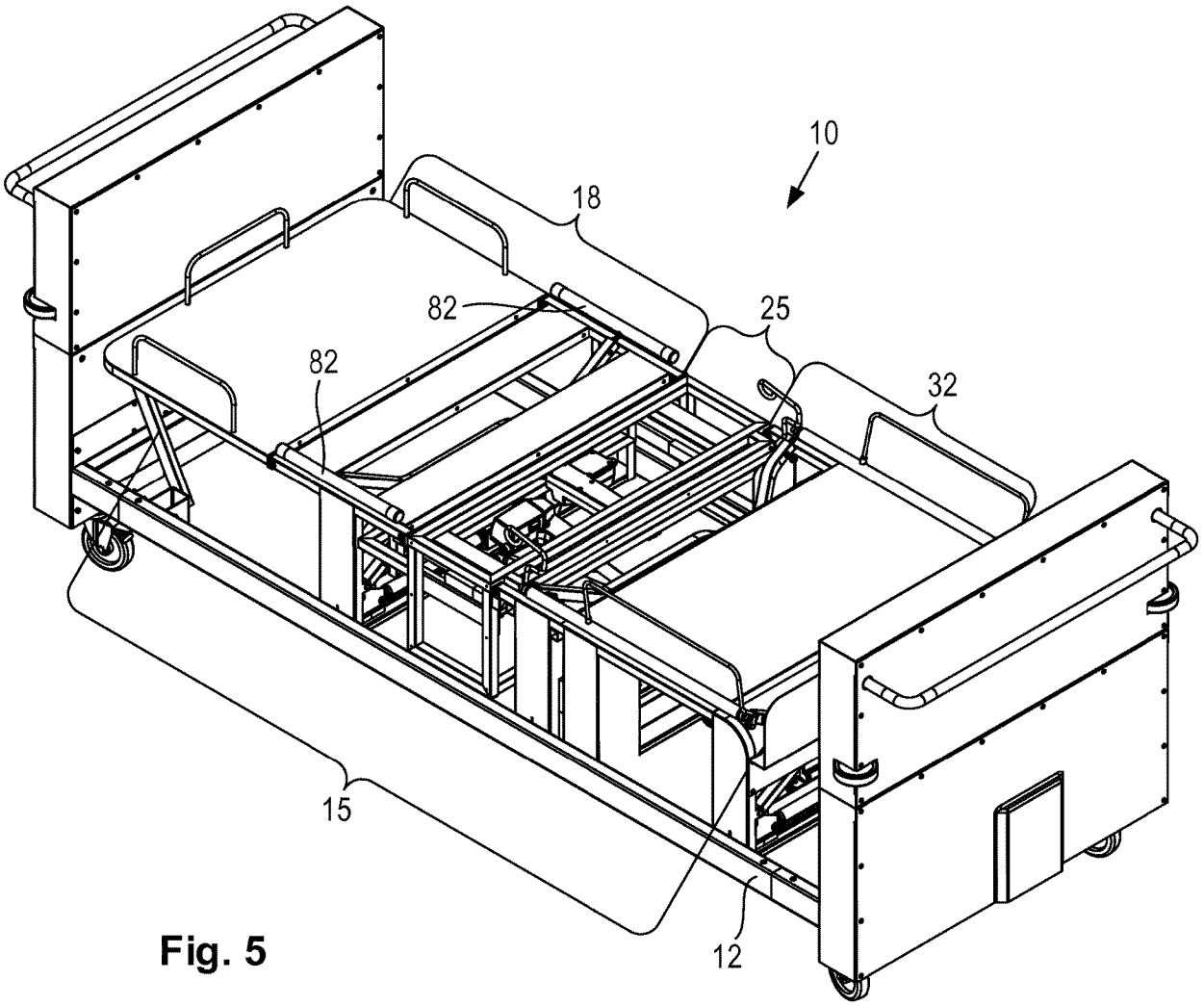
FIG. 5 is a perspective view of the articulating bed of FIG. 2.

The thoracic area bearing structures depicted in the drawings comprise elevators 70 (FIGS. 6, 9, 10, 14, 17) are part of a modulating superframe 60 (FIG. 4). The elevators 70, which are similar in many respects to those described in U.S. Pat. No. 7,559,102, which is incorporated herein by reference, manipulate the surface of the bed to cause it to tilt right or left, twist, go into a cradling position, or assume any of several other conceivable configurations and programmable modulations that fall within the limits of the elevators' ranges of motion. The modulating superframe 60 provides an additional layer of functionality, beyond articulations of the midframe 15, for manipulating the bed surface. In particular, the superframe 60 enables the surface to be modulated through action on a plurality of superframe. The superframe modulation points 82 are located at left and right head end, lower thoracic, and upper leg portions of the patient support surface 24.

The modulating superframe 60 depicted herein differs from the embodiments described in U.S. Pat. No. 7,761,942, which is also incorporated herein by reference, in some respects. For one, each left/right pair of elevators 70 is coupled together in a scissoring mechanism 71 (FIG. 17), which adds strength. Also, spring-loaded hooks 78 are provided at the lower thoracic superframe modulation points.

It should be appreciated that the modulating superframe 60 includes structural components and provides a number of functions that are ancillary to the functions of reducing shear and compressive forces during bed articulation. Thus, the present invention encompasses beds that do not include a modulating superframe 60 or that provide a more conventional patient support surface. For example, in an alternative embodiment, the bed 10 has a stationary superframe (in place of the modulating superframe 60) that suspends a patient support surface 24 over the articulating midframe 15, causing the patient support surface 24 to substantially conform to whatever configuration the articulating midframe assumes. And in yet another alternative embodiment, the bed 10 has—in place of a superframe 60—a complete deck mounted to the articulating midframe 15, along with a deck portion that recesses as the thorax assembly subframe 38 travels toward its second extent.

Four substantially vertically-oriented and rectilinear actuator cages or cartridges, each having a major transverse axis and a minor vertical axis, are mounted to corresponding portions of the underside of the articulating midframe 15. Each of the cages or cartridges houses actuators used to provide various bed functions. Each of the cages or cartridges may also serve as stands for the corresponding portions of the articulating midframe 15—that is, supporting the midframe 15 on the base frame 12—when the bed 10 is in a flat position.

Starting at the head end of the bed, an upper thorax area cartridge 64 is fixedly mounted to an underside of the thorax assembly 32. It houses a support-surface-modulating actuator configured as two elevators 70 used to manipulate the upper left and right corners of the patient support surface.

Next, a subframe carrier 72 is fixedly mounted to an underside of the thorax assembly 32. The subframe carrier 72 houses an actuator 74 that causes the thorax assembly subframe 18 to slide relative to the thorax assembly main frame 15.

Next, the lower thorax area cartridge 66 is mounted on glides 76 for sliding movement with respect to the subframe carrier 72. The lower thorax area cartridge 66 houses two more elevators 70 used to manipulate the lower thoracic left and right corners of the patient support surface 24.

Finally, a thigh area cartridge 68 is mounted to the underside of the upper leg assembly 22. The thigh area cartridge 68 houses yet another pair of elevators 70 used to manipulate left and right upper leg portions of the patient support surface 24.

Figure 6:
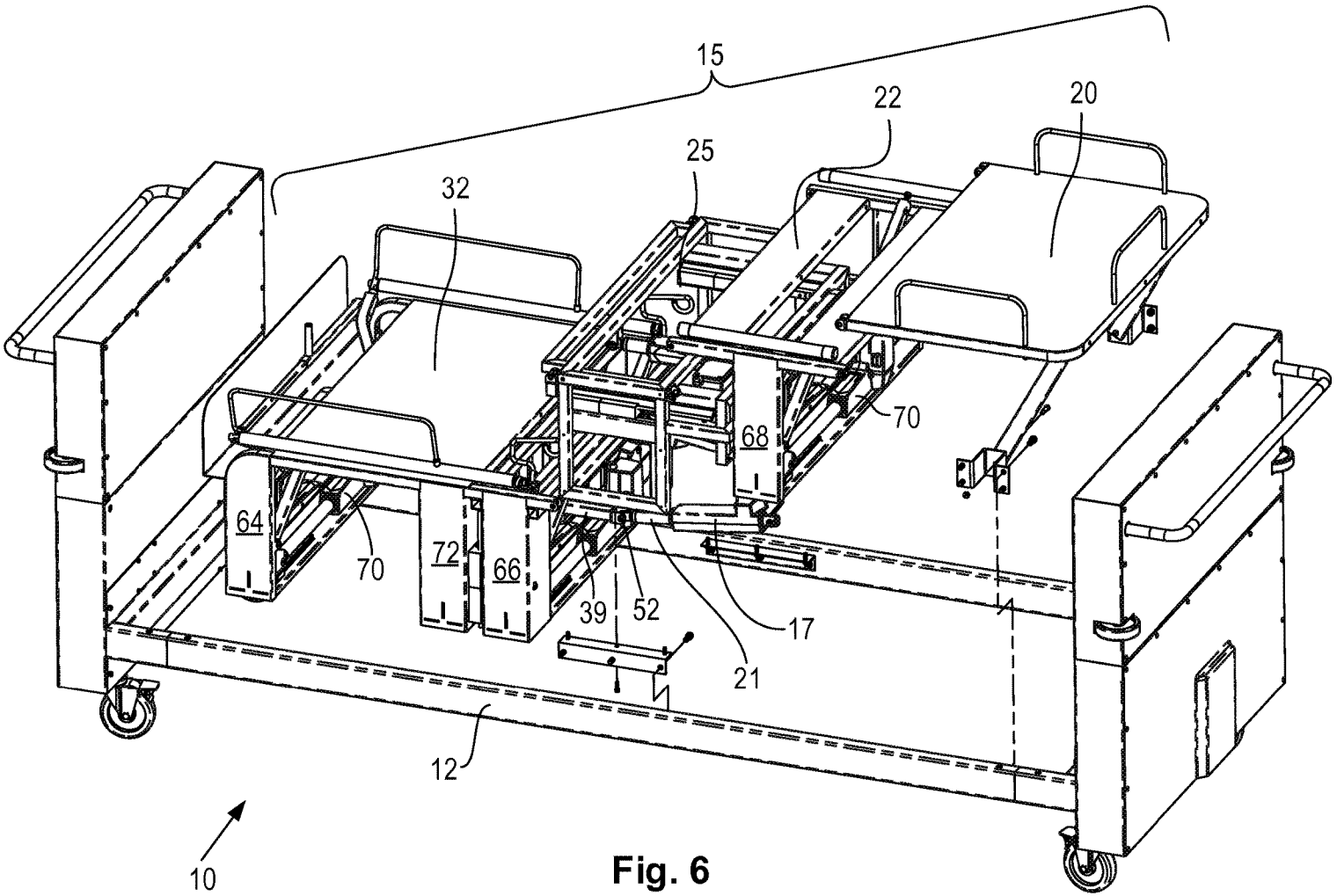
FIG. 6 is an exploded view of the articulating midframe of the bed of FIG. 1.
Figure 7:
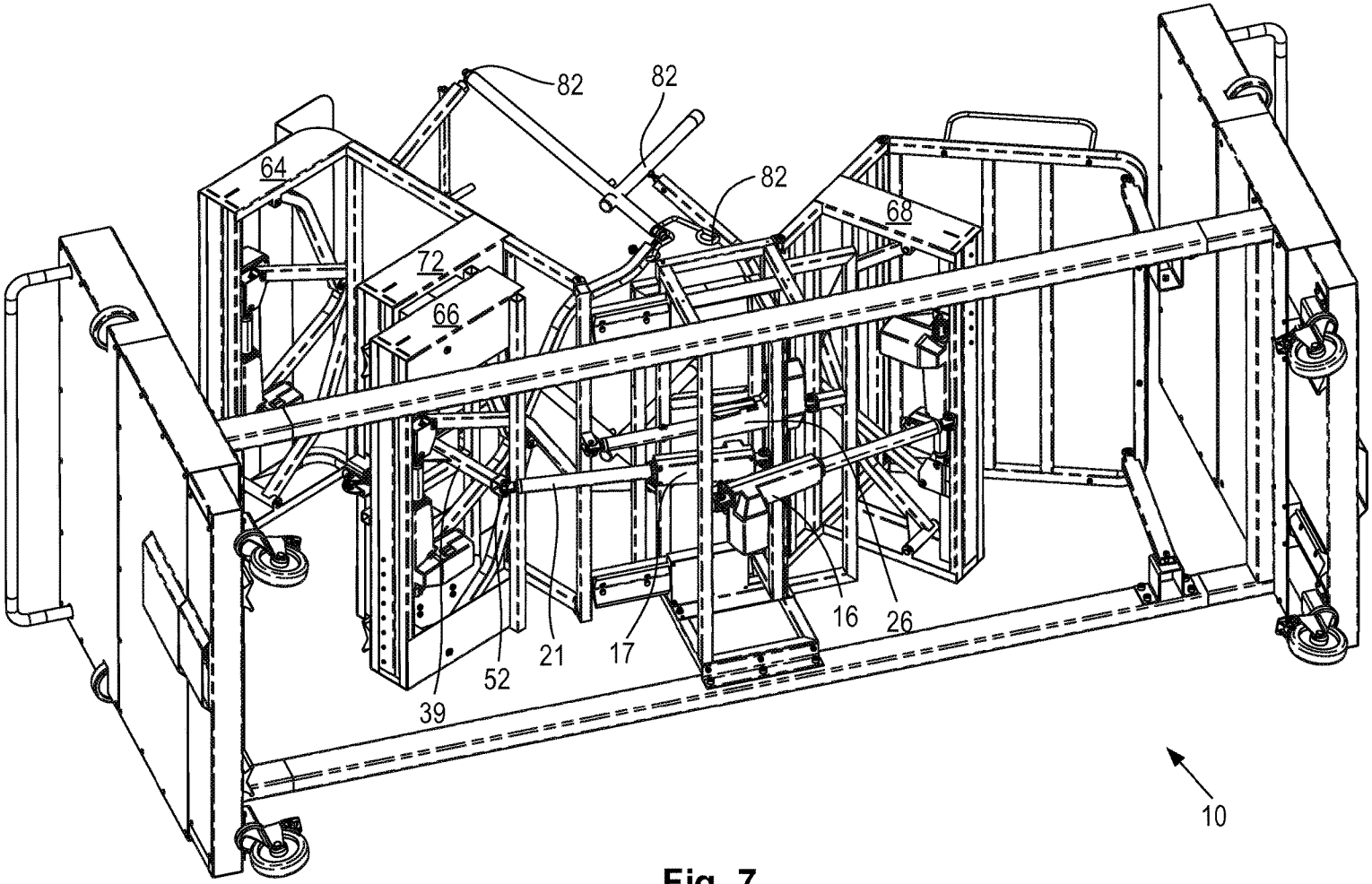
FIG. 7 is a perspective view from a bottom angle of the articulating bed of FIG. 1.
Figure 8:
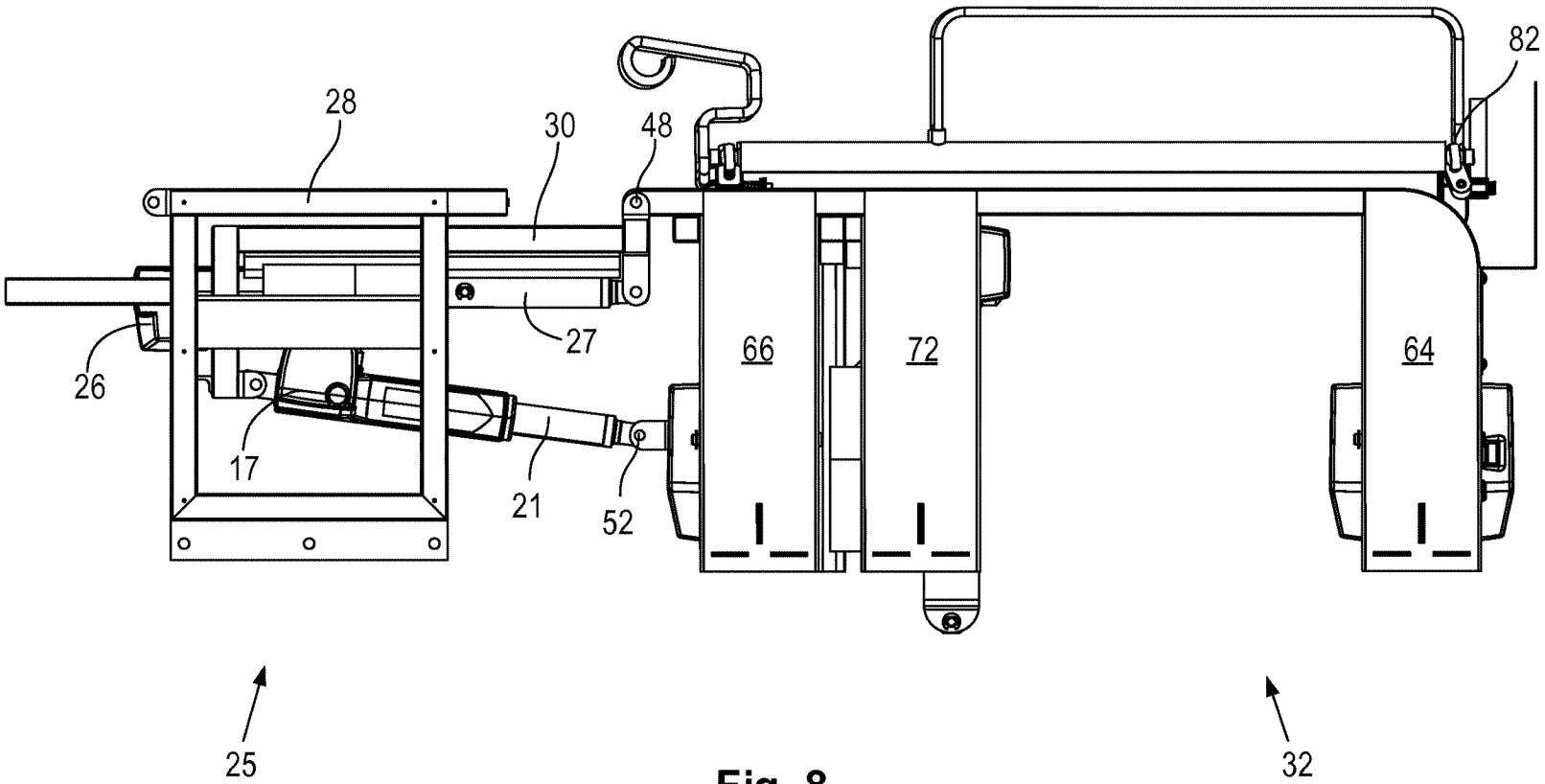
FIG. 8 is a side plan view of one embodiment of the thorax and pelvic assemblies of the articulating bed of FIG. 1, with the thorax and pelvic assemblies resting in a flat, unarticulated position, the first displacement mechanism in an extended position, the second displacement mechanism in a neutral position, and corresponding portions of the modulating superframe in a reposed configuration.
Figure 9:
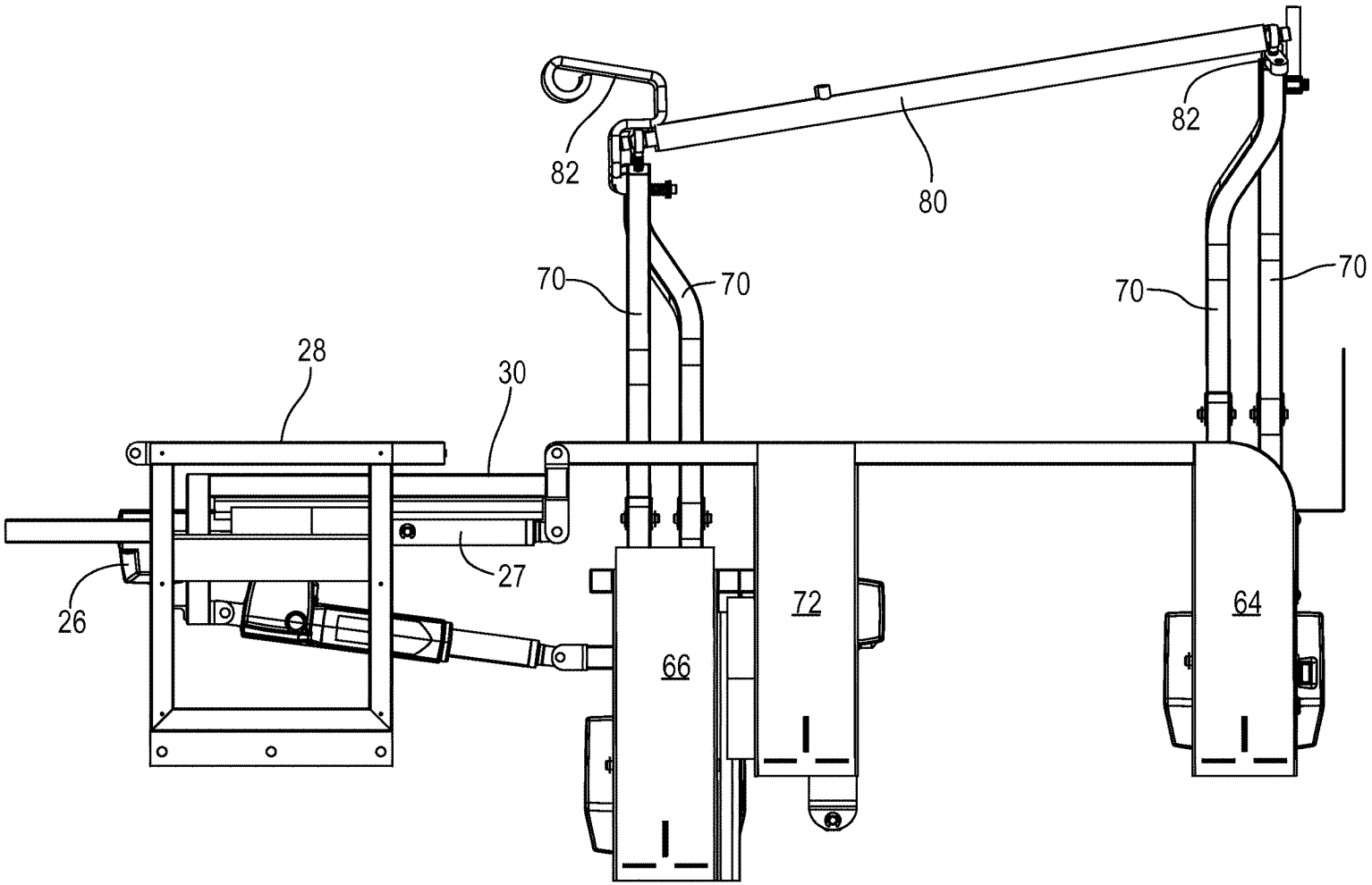
FIG. 9 is like FIG. 8 but with the second displacement mechanism in a deeply recessed position and the thorax portion of the modulating superframe in an extended configuration.

To articulate the thorax assembly 32 with respect to the pelvic assembly 25, a thorax assembly articulation actuator 17 drives a rod 21 that is pivotally connected, at a pivot 52, to a thorax assembly articulation lever 39 (FIG. 6). In the depicted embodiment, the thorax assembly articulation lever 39 comprises a beam that extends from the thorax assembly subframe carrier 72 through an opening in the lower thorax area cartridge 66. The opening is large enough to allow the lower thorax area cartridge 66 to move across its range of travel without the beam interfering with the cartridge 66.

The motion of the thorax assembly articulation actuator 17 to extend the rod 21 causes the thorax assembly 32 to pivot about the torso tilt axis 48 coupling the thorax assembly main frame 35 to the pelvic assembly subframe 38. Similarly, retracting the rod 21 causes the thorax assembly main frame 28 to recline toward a level position.

To articulate the leg assembly 18 with respect to the pelvic assembly 25, a leg assembly articulation actuator 16 drives a rod 19 that is pivotally connected to the thigh area cartridge 68 (FIG. 4). So, it will be appreciated that, in the illustrated drawings, three independently operable actuators—a leg assembly articulation actuator 16, a thorax assembly articulation actuator 17, and a pelvic assembly subframe driving actuator 26, are mounted to the pelvic assembly 25.

It will be further appreciated that, in the illustrated embodiments, a total of five independently operable actuators—the subframe carrier actuator 72 and four modulating superframe elevators 70—are mounted to the thorax assembly 32.

And again, it will be appreciated that, in the illustrated embodiments, two additional independently operable actuators—two modulating superframe elevators 70—are mounted to the leg assembly 18.

The actuators may comprise motors, worm drives, hydraulic cylinders, or any other suitable structures.

However, it is important to again stress that much of the structure depicted in the drawings, including most of the actuators, are ancillary to the function of minimizing compressive and shear forces on the patient during bed articulation. Accordingly, the invention should not be construed as being limited to these details unless and to the extent expressly so stated in the claims.

Having thus described exemplary embodiments of the present invention, it should be noted that the disclosures contained in FIGS. 1-17 are exemplary only, and that various other alternatives, adaptations, and modifications may be made within the scope of the present invention. Accordingly, the present invention is not limited to the specific embodiments illustrated herein, but is limited only by the following claims.

We claim:

1. An articulating bed comprising: a base frame configured to support the articulating bed on a floor; a support surface; a pelvic assembly mounted on the base frame; a thorax assembly mounted on the base frame and beneath the support surface and coupled for articulation to the pelvic assembly about an articulation axis between flat and inclined orientations, wherein: the thorax assembly includes a thorax assembly main frame and a lower thorax area cartridge; the lower thorax area cartridge is slidably mounted to the thorax assembly main frame and operative for straight linear travel between upper and lower positions relative to the thorax assembly main frame, wherein in the lower position, the lower thorax area cartridge is downwardly displaced from the thorax assembly main frame; the lower thorax area cartridge is positioned under a portion of the support surface configured to support a lower thoracic region of a person lying on the support surface, the lower thorax area cartridge coupled to the thorax assembly main frame for travel along an axis that is substantially perpendicular to a deck section of the thorax assembly main frame; the thorax assembly main frame is positioned under a portion of the support surface configured to support an upper thoracic region of a person lying on the support surface; the lower thorax area cartridge and the main frame each bear corresponding portions of the support surface; and a displacement mechanism including a first actuator coupled to the lower thorax area cartridge and the thorax assembly main frame, the first actuator configured to displace the thorax area cartridge toward the lower position as the thorax assembly is articulated toward the inclined orientation; the displacement mechanism also being configured to displace the thorax area cartridge toward the upper position as the thorax assembly is articulated toward the flat orientation.

2. The articulating bed of claim 1, wherein the displacement mechanism comprises guides that slidingly couple the lower thorax area cartridge for linear travel with respect to the thorax assembly main frame between the upper and lower positions.

3. The articulating bed of claim 1, further comprising a second displacement mechanism that displaces a pelvic assembly subframe outwardly from a pelvic assembly main frame.

4. The articulating bed of claim 1, further comprising a thorax assembly articulation actuator coupled to a thorax assembly articulation lever and operable to drive the thorax assembly between the flat and inclined orientations.

5. The articulating bed of claim 4, wherein the thorax assembly articulation lever is fixedly mounted to the thorax assembly main frame, and the lever extends through an opening in the lower thorax area cartridge; wherein the thorax assembly articulation lever is operable to drive the thorax assembly main frame without interference with the lower thorax area cartridge, and the lower thorax area cartridge is operable to travel between the upper and lower positions without interference with the thorax assembly articulation lever.

6. The articulating bed of claim 1, further comprising a scissoring mechanism mounted to the lower thorax area cartridge and operable to raise and contract a corresponding portion of the support surface to embrace an abdominal area of a person lying on the surface.

7. The articulating bed of claim 1, further comprising a head-end scissoring mechanism mounted to the thorax assembly main frame and operable to raise and contract a corresponding portion of the patient support to cradle a patient's upper body and head.

8. An articulating bed comprising: a base frame configured to carry the articulating bed on a floor; a pelvic assembly and a thorax assembly mounted on the base frame; the pelvic assembly comprising a pelvic assembly subframe slidingly coupled to a pelvic assembly main frame for linear travel along a longitudinal axis extending between a foot end of the bed and a head end of the bed; a thorax assembly comprising a lower thorax area cartridge slidingly coupled to a thorax assembly main frame for straight linear travel along the thorax assembly main frame between relatively elevated and lower positions with respect to the thorax assembly main frame, the lower thorax area cartridge coupled to the thorax assembly main frame for travel along an axis that is substantially perpendicular to a deck section of the thorax assembly main frame; a pelvic assembly actuator operable to extend and retract the pelvic assembly subframe with respect to the pelvic assembly main frame as the thorax assembly articulates between flat and inclined orientations; and a thorax assembly actuator coupled to the lower thorax area cartridge and the thorax assembly main frame, the thorax assembly actuator operable to extend and retract the lower thorax area cartridge with respect to the thorax assembly main frame as the thorax assembly articulates between the flat and inclined orientations.

9. The articulating bed of claim 8, wherein the thorax assembly actuator is operable to extend the lower thorax area cartridge away from the deck section as the thorax assembly articulates from the flat orientation to the inclined orientation.

10. The articulating bed of claim 9, wherein the pelvic assembly actuator is operable to extend the pelvic assembly subframe outwardly as the thorax assembly articulates from the flat orientation to the inclined orientation.

11. The articulating bed of claim 8, further comprising a thorax assembly articulation actuator coupled to a thorax assembly articulation lever and operable to drive the thorax assembly between the flat and inclined orientations.

12. The articulating bed of claim 11, wherein the thorax assembly articulation lever is fixedly mounted to the thorax assembly main frame, and the lever extends through an opening in the lower thorax area cartridge; wherein the thorax assembly articulation lever is operable to drive the thorax assembly main frame without interference with the lower thorax area cartridge, and the lower thorax area cartridge is operable to travel between the relatively elevated and lowered positions with respect to the thorax assembly main frame without interference with the thorax assembly articulation lever.

13. The articulating bed of claim 8, further comprising a scissoring mechanism mounted to the lower thorax area cartridge and operable to raise and contract a corresponding portion of the support surface to embrace an abdominal area of a person lying on the surface.

14. The articulating bed of claim 8, further comprising a head-end scissoring mechanism mounted to the thorax assembly main frame and operable to raise and contract a corresponding portion of the patient support to cradle a patient's upper body and head.

15. An articulating bed comprising: a pelvic assembly; a thorax assembly coupled for articulation to the pelvic assembly and configured to articulate between flat and inclined orientations; the pelvic assembly including a pelvic assembly subframe coupled to a pelvic assembly main frame and operable to translate outwardly toward a head-end of the bed when the thorax assembly articulates toward the inclined orientation; the thorax assembly including a thorax main frame pivotally coupled to the translating pelvic assembly subframe; and the thorax assembly also including a sliding lower thorax area cartridge coupled for straight linear translation between upper and lower positions relative to the thorax assembly main frame and in a direction that is substantially perpendicular to a deck section of the thorax assembly main frame.

16. The articulating bed of claim 15, further comprising a support surface mounted to the pelvic and thorax assemblies and further mounted for movement with the pelvic assembly subframe and lower thorax area cartridge to reduce shear and compression forces on a patient as the thorax assembly articulates between the flat and inclined orientations.

17. The articulating bed of claim 15, further comprising guides that slidingly couple the lower thorax area cartridge for linear travel with respect to the thorax assembly main frame.

18. The articulating bed of claim 1, wherein the lower thorax area cartridge is rectilinear.

19. The articulating bed of claim 1, wherein the lower thorax area cartridge houses a support-surface-modulating actuator.

* * * * *